United States Patent [19]

Cyr

[11] 4,187,929

[45] Feb. 12, 1980

[54] SCAFFOLD STABILIZER

[76] Inventor: Leonide A. Cyr, 912 Howard Ave., Bridgeport, Conn. 06605

[21] Appl. No.: 930,764

[22] Filed: Aug. 3, 1978

[51] Int. Cl.[2] ..... E04G 5/08; E04G 7/28

[52] U.S. Cl. ..... 182/222; 182/129; 182/150; 248/235

[58] Field of Search ..... 182/222, 223, 142, 129, 182/229, 150; 24/255, 259, 251; 248/225.3, 235; 403/388

[56] References Cited

U.S. PATENT DOCUMENTS

| | | | |
|---|---|---|---|
| 1,737,315 | 11/1929 | MacDonald | 182/222 |
| 1,802,385 | 4/1931 | Kisinger | 403/388 |
| 1,858,656 | 5/1932 | Batherman | 182/129 |
| 2,174,891 | 10/1939 | Maran | 182/121 |
| 2,569,450 | 10/1951 | Bouton | 182/222 |
| 2,928,443 | 3/1960 | Sevahko | 182/222 |
| 2,982,982 | 5/1961 | Swift | 248/225.3 |
| 3,978,555 | 9/1976 | Weisenthal | 24/255 SL |

*Primary Examiner*—Reinaldo P. Machado
*Attorney, Agent, or Firm*—Thomas L. Tully

[57] ABSTRACT

A scaffold stabilizer for use on a scaffold platform, consisting of a multiplicity of longitudinal planks of uniform thickness assembled in side-by-side contact to form a supporting floor or platform for workers. The stabilizer comprises a generally C-shaped unitary metallic clamping member comprising upper and lower plate members rigidly connected to an end plate member, the upper and lower plate members being sufficiently long and defining therebetween an opening sufficiently wide and long to receive a multiplicity of flooring planks in close side-by-side engagement. At least one of the plate members is bowed towards the other so as to provide a tight frictional engagement with one surface of the planks present therein. The upper and lower plate members are provided with means for securing and tightening the ends thereof together at a location adjacent the outermost plank contained within the clamping member. According to a preferred embodiment, the upper plate member is longer than the lower plate member to provide a workpiece-supporting surface when said clamping members are used in spaced pairs.

7 Claims, 3 Drawing Figures

SCAFFOLD STABILIZER

BACKGROUND OF THE INVENTION

Scaffolds are in common use by tradesman in connection with the construction, repair, siding and painting of houses and other buildings. Such scaffolds may be suspended from the roof or upper portions of the house or building, using scaffold hangers in association with ropes and pulleys for adjustable vertical movement, or may be supported by sawhorses or temporary wooden or tubular metal structures attached to the house or building for the purpose. In nearly all cases, the platform for the scaffold consists of a number of similar long planks which are placed together side-by-side, and are supported at each end by resting upon horizontal supports, such as suspended scaffold hangers, sawhorse bars or wooden or tubular metal support structures.

In order to reduce the number of times which the scaffold must be moved, the platform is made as long as possible. Thus, planks having a length of 12 feet or 14 feet are generally used. Also, in order to reduce the effort involved in moving the scaffold, the planks used for the flooring are generally no thicker than about 2 inches. The planks used most frequently are 2"×8", 2"×10" and 2"×12", each 14 feet in length.

As can be understood, scaffold platforms consisting of planks of these dimensions, supported adjacent the ends thereof, tend to bow under the weight of a worker standing near the center thereof. Such bowing generally does not present a hazard provided that all of the planks bow at the same time and to the same degree. Otherwise, the planks supporting the worker's feet bow while adjacent planks do not, thereby creating an obstacle which can cause the worker to trip. Also, if all of the worker's weight is supported by only one or two of the planks, breakage is more likely to occur.

In an effort to overcome these problems, the workmen most frequently nail one or more pieces of 1"×3" wood board in a transverse direction across the planks on the surface of the scaffold platform, the boards being nailed to each of the planks so that the planks bow together and support each other under the weight of the worker. Such wood supports are disadvantageous because their application and removal is time-consuming; they can break or become separated during use; they are not reusable and thus are expensive; and they are relatively thick and present a tripping hazard to the worker.

Metallic cross-supports have been proposed for scaffold platforms but none of these have been commercially successful for any one of several reasons. They either consist of tubular steel which is thick and presents a tripping hazard and/or they are difficult and time-consuming to apply since they comprise long threaded members and/or they are not effective in providing adequate support to adjacent planks to resist bowing or to cause all of the planks to bow in similar manner when the weight of the worker is present on only one or two of the planks.

SUMMARY OF THE INVENTION

The present invention relates to novel scaffold stabilizer clamps which are adapted for simple and quick attachment as cross-supports over a number of planks which form the platform of the scaffold, the clamps being formed of flat steel which is strong and relatively thin to reduce the danger of tripping. The present clamps include attached upper and lower plate members, at least one of which is bowed toward the other so as to tightly frictionally engage the planks inserted therebetween, and means for connecting the open ends of the clamps to draw the plate members together and tighten the frictional engagement with the planks present therein.

According to a preferred embodiment, the present scaffold stabilizer clamps also comprise workpiece supports adapted to hold elongated workpieces, such as lumber and lengths of siding adjacent and parallel to but free from the platform surface within convenient reach of the workman without encumbering the worker-supporting platform.

DESCRIPTION OF THE PREFERRED EMBODIMENTS

Figure 1:
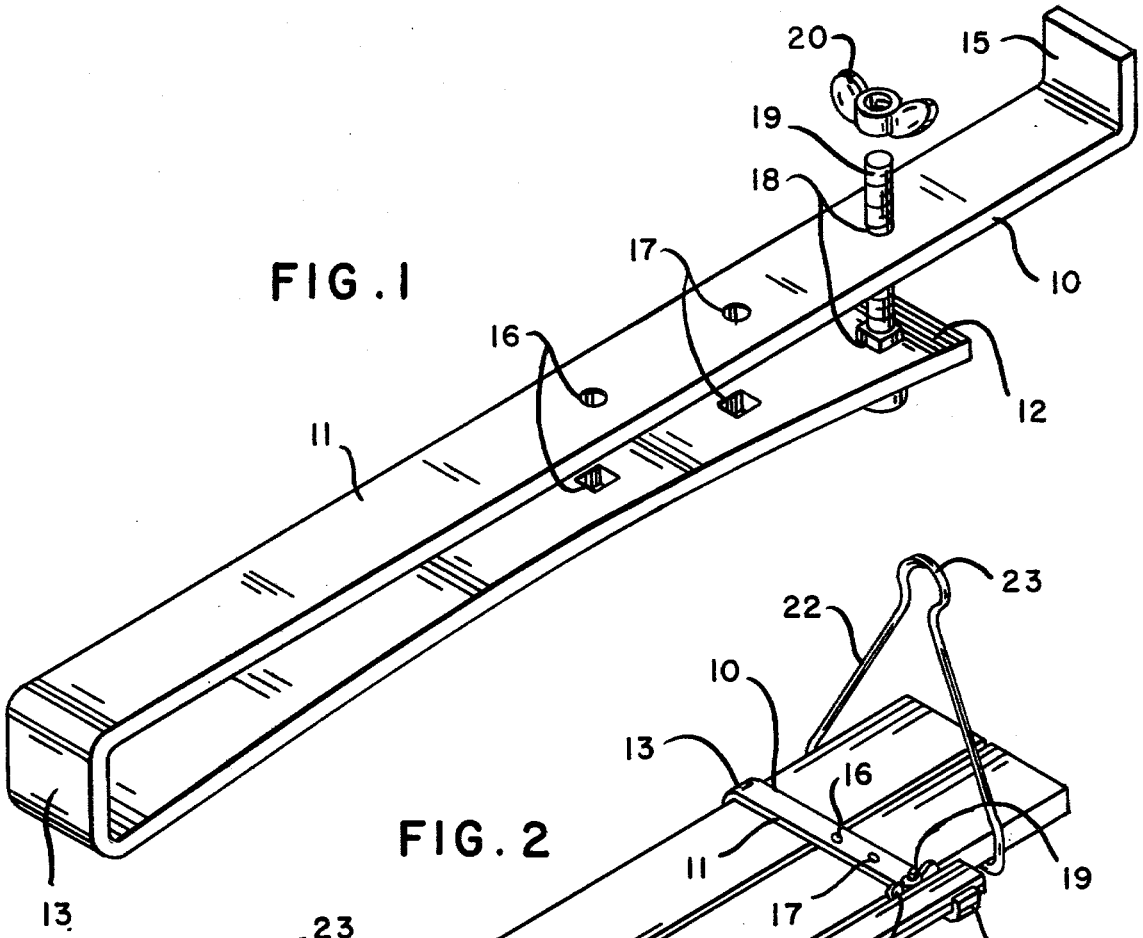
FIG. 1 is a perspective view of a scaffold stabilizer having a workpiece-supporting extension according to a preferred embodiment of the present invention.
Figure 2:
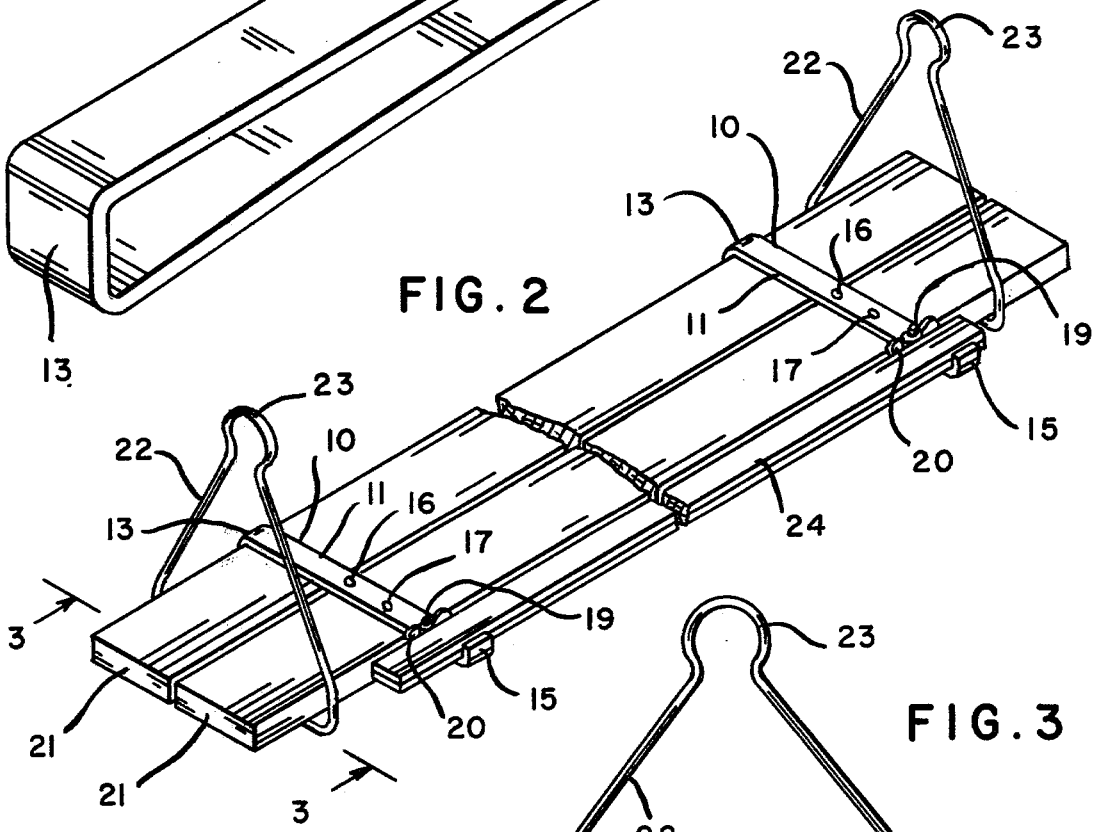
FIG. 2 is a perspective view of a suspended scaffold containing two spaced stabilizers of the type shown in FIG. 1.
Figure 3:
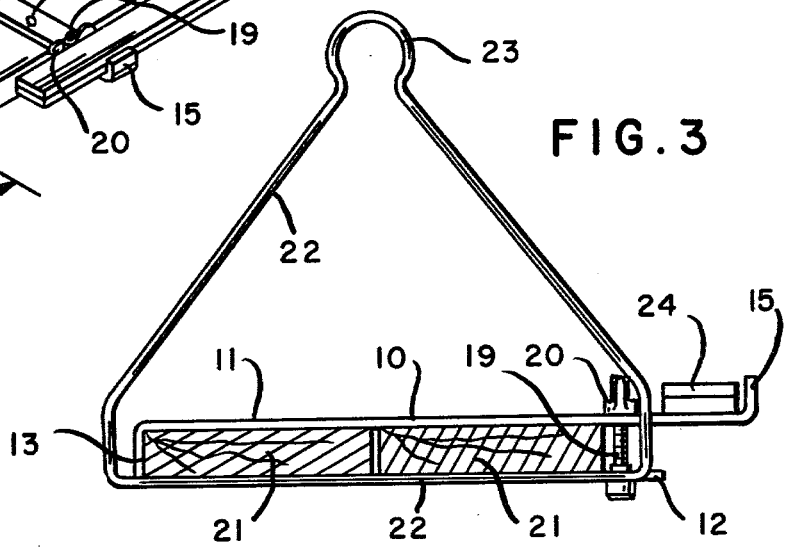
FIG. 3 is a view taken along the line 3—3 of FIG. 2.

Referring to FIG. 1 of the drawing, a preferred scaffold stabilizer 10 comprises an elongate steel strip, such as steel having a length of about sixty-eight inches, a width of about one and one-half inches and a thickness of about three-eighths of an inch is formed into the C-shape illustrated so as to have an upper plate member 11, a bowed lower plate member 12 and an end plate member 13, the dimensions being such that the lower plate member has a length of about 26 inches, the end plate member has a length of about 2 inches and the top plate member has a length of about 40 inches, the difference in length between the top plate member 11 and the lower plate member 12 comprising a workpiece supporting extension 14 having a three inch long upturned flange 15 comprising a retainer for workpieces carried on the extension 14, as shown by FIGS. 2 and 3.

The upper and lower plate members are provided with correspondingly-located and spaced pairs of holes 16, 17 and 18, each pair adapted to receive a bolt 19 and wing nut 20 to tighten the ends of the plate members 11 and 12 after wooden planks 21 of the desired width are inserted between the plate members to form the platform of the scaffold, as shown by FIGS. 2 and 3 in connection with wide planks which require insertion of bolt 19 into the outermost pair of holes 18.

The preferred stabilizer attachment, as illustrated, has dimensions approximating those mentioned hereinbefore since the planks most commonly used in the construction trade have a thickness of about 2 inches, i.e., 2"×8", 2"×10" and 2"×12". Thus, the plate members are spaced by a distance of about 2 inches so that planks can be inserted therebetween, and the centers of holes 16, 17 and 18 are spaced from the end plate member by distances of about 17", 21" and 25" so as to accommodate a pair of 8" planks within holes 16, a pair of 10" planks within holes 17 or a pair of 12' planks within holes 18. Thus, the pair of holes engaged by bolt 19 and nut 20 depends upon the width of the planks used, the nut and bolt always being attached to the pair of holes closest to the outer edge of the outermost plank. As illustrated by FIG. 1, the holes 16, 17 and 18 in the lower plate member 12 preferably are squared to provide turn-resistant engagement with bolt 19 which preferably is a carriage bolt having a squared sub-head with dimensions providing locking engagement with said squared holes.

An essential feature of the present stabilizers is the provision of an inward bow, preferably in the lower plate member 12, positioned so as to apply an upward pressure against the planks secured within the stabilizer, particularly in the center area where the two planks contact each other. Such bow and upward pressure cause the two planks to be compressed tightly between the plate members 11 and 12, particularly in the center area where the planks meet each other, thereby preventing the edge of one plank from moving above or below the edge of the other plank, which movement would present a tripping hazard. Also, the planks clamped in this manner tend to support each other when either one of them alone is carrying the wright of a workman, thereby reducing the probability of breakage.

The present stabilizers, as illustrated, are designed to be most effective with wider planks, i.e., 12" planks, since such planks present the greatest problem relative to a tripping hazard because they are sufficiently wide that a workman frequently will stand upon only one of the planks of a platform based upon such wide planks, causing that plank to move downward or bow while the adjacent plank remains flat. Thus, the illustrated stabilizer has the inward bow located midway between the end plate member 13 and the outermost holes 18 so that the uppermost curve of the bow will meet the planks 12 where they contact each other in the center of the width of the platform to apply the greatest clamping pressure in this area when the wing nut 20 is tightened on bolt 19 to bring the ends of plate members 11 and 12 as close as possible, as shown by FIG. 3.

It should be understood that the present stabilizers may be formed in dimensions to accommodate planks of any desired width and thickness and that separate stabilizers may be formed with a single pair of holes positioned to accommodate a pair of planks of any desired width, i.e., hole pairs 16 and 17 may be omitted from the stabilizer of the drawing, whereby it is adapted for use with 12" planks, the bow in plate 12 being centered for greatest effectiveness.

As illustrated by FIG. 2, the present stabilizers are generally used in pairs, spaced from each other and from the ends of the planks for maximum efficiency. The clamped planks 21 form the platform of the scaffold and the scaffold is suspended on end supports, such as a pair of triangular metal hangers 22 provided with upper hoops 23 adapted to be secured to ropes or cables suspended from the upper area of a house or building. The number of stabilizers and their spacing may be varied to accommodate planks and workpieces of different lengths.

The preferred stabilizers 10 are provided with upper plate member extensions 14 which project beyond the platform and are adapted to support elongate workpieces 24, such as strips of lumber or siding adjacent to the platform but removed therefrom so as not to interfere with the movement of the workmen on the platform. The retainer 15 may be one which extends upwardly to any desired height to accommodate as many workpieces 24 as desired or to accommodate slightly larger workpieces, provided that their weight is not excessive. The upper end of the bolts 19 and the wing nuts 20 engaged thereon also function as retainers to confine the workpieces 24 between them and the flange retainer 15 whereby the workpieces 24 are prevented from movement onto the platform during agitation of the scaffold, such as may occur as a result of contact of a suspended scaffold with a building during vertical movement of the scaffold.

It will be clear to those skilled in the art in the light of the present disclosure, including the drawing, that variations may be made in the dimensions of the plate stack used to form the present stabilizers, the shape of the inward bow in the lower plate member 12, the means used to secure the ends of the plates 11 and 12 and the size of the workpiece-supporting extension 14 and flange 15. In all cases, it is desirable that the thickness of the upper plate member 11 be retained as small as practical so that the danger of the workman tripping thereover is minimized. Thus, such thickness should not exceed about one-half inch. A preferred embodiment, from the standpoint of safety, lightness of weight and ease of use involves the use of thinner, stronger and more flexible metal, such as tensilized or tempered steel which is as thin as about one-eighth of an inch. Such steel presents a minimum tripping hazard, is ligher and easier to install and has greater flexibility for maximum effectiveness in the area of the bow.

Also, particularly in cases where the present stabilizers are always used with planks of the same width and thickness, it may be desirable to replace the particular hole 16, 17 or 18 of the lower plate member 12 with a slot which is open to one side of member 12 so that the wing nut 20 need not be removed from bolt 19 to disengage the same, i.e., the bowed end of member 12 can be pressed upward against the underside of the planks to release tension on the nut and bolt so that the head of the bolt can be slipped out of the slot. Alternatively, bolt 19 may be a hook bolt which passes around the side edge of member 12 and engages the hole 16, 17 or 18 from the underside, or bolt 19 may have a triangular eye in place of a head, the triangular eye slipping over member 12 in a manner similar to the engagement of metal hangers 22 with planks 21.

Variations and modifications will be apparent to those skilled in the art within the scope of the appended claims.

I claim:

1. A scaffold stabilizer adapted for use on a scaffold platform consisting of a multiplicity of longitudinal planks of uniform thickness assembled in side-by-side contact, said attachment comprising a generally C-shaped unitary metallic clamping member comprising elongate upper and lower plate members rigidly attached to a shorter end plate member so as to define an opening sufficiently wide and long to receive a multiplicity of planks in side-by-side contact with each other, said upper and lower plate members being provided with means for securing the ends thereof together at a point beyond the outer edge of the outermost plank contained therebetween, said upper plate member being longer than said lower plate member to provide an extension beyond said securing means adapted to support workpieces adjacent said scaffold, and said lower plate member being provided with an upward bow towards said upper plate member, said bow being adapted to provide an area of increased pressure on planks within said stabilizer attachment when said securing means is tightened.

2. A scaffold stabilizer according to claim 1 in which said extension is provided with retainer means adapted to retain workpieces on said extension.

3. A scaffold stabilizer according to claim 1 in which said securing means extends above said upper plate member to provide a retainer means adapted to prevent workpieces from moving from said extension onto said outermost plank.

4. A scaffold stabilizer according to claim 1 in which said metallic clamping member consists of tempered steel.

5. A scaffold stabilizer according to claim 1 in which said securing means comprises a nut and bolt which engage each other through holes in said upper and lower plate members.

6. A scaffold stabilizer according to claim 5 in which said bolt is a carriage bolt, the opening in the lower plate member is a square opening providing turn-resistant engagement with said carriage bolt, and said nut is a wing nut which extends above said upper plate member.

7. A scaffold stabilizer according to claim 6 in which said upper and lower plate members are provided with a multiplicity of spaced holes whereby said stabilizer is adapted to contain a multiplicity of planks of different widths and said nut and bolt are adapted to be engaged in the pair of holes closest to the outer edge of the outermost plank.

* * * * *

UNITED STATES PATENT AND TRADEMARK OFFICE

CERTIFICATE OF CORRECTION

PATENT NO. : 4,187,929

DATED : February 12, 1980

INVENTOR(S) : LEONIDE CYR

It is certified that error appears in the above-identified patent and that said Letters Patent are hereby corrected as shown below:

Col. 2, line 62, " 12' " should read --12"--; col. 4, line 22, "ligher" should read --lighter--; col. 6, line 6, Claim 7, line 1, "6" should read --5--.

Signed and Sealed this

*Seventeenth* Day of *June 1980*

[SEAL]

*Attest:*

SIDNEY A. DIAMOND

*Attesting Officer*

*Commissioner of Patents and Trademarks*